US011692237B2

(12) United States Patent
Bonnet

(10) Patent No.: US 11,692,237 B2
(45) **Date of Patent: *Jul. 4, 2023**

(54) METHOD OF DYNAMICAL ADJUSTMENT FOR MANUFACTURING A THERMALLY TREATED STEEL SHEET

(71) Applicant: ArcelorMittal, Luxembourg (LU)

(72) Inventor: Frédéric Bonnet, Avril (FR)

(73) Assignee: ArcelorMittal, Luxembourg (LU)

( * ) Notice: Subject to any disclaimer, the term of this patent is extended or adjusted under 35 U.S.C. 154(b) by 609 days.

This patent is subject to a terminal disclaimer.

(21) Appl. No.: 16/469,930

(22) PCT Filed: Dec. 20, 2017

(86) PCT No.: PCT/IB2017/058189
§ 371 (c)(1),
(2) Date: Jun. 14, 2019

(87) PCT Pub. No.: WO2018/116194
PCT Pub. Date: Jun. 28, 2018

(65) Prior Publication Data

US 2019/0352739 A1 Nov. 21, 2019

(30) Foreign Application Priority Data

Dec. 20, 2016 (WO) ..... PCT/IB2016/001790

(51) Int. Cl.
*C21D 11/00* (2006.01)
*C21D 9/46* (2006.01)
(Continued)

(52) U.S. Cl.
CPC ..... *C21D 11/005* (2013.01); *C21D 9/46* (2013.01); *C22C 38/001* (2013.01);
(Continued)

(58) Field of Classification Search
CPC ..... B21B 37/74; B21B 37/76; C21D 11/00; C21D 11/005; C21D 2211/001;
(Continued)

(56) References Cited

U.S. PATENT DOCUMENTS 4,440,583 A 4/1984 Ikegami et al.
5,891,275 A 4/1999 Elfmark et al.
(Continued)

FOREIGN PATENT DOCUMENTS

CN 102851474 A 1/2013
CN 105838869 A 8/2016
(Continued)

OTHER PUBLICATIONS

International Search Report issued in connection with International application No. PCT/IB2017/058189 dated Feb. 27, 2018.
(Continued)

*Primary Examiner* — Jenny R Wu
(74) *Attorney, Agent, or Firm* — Davidson, Davidson & Kappel, LLC

(57) ABSTRACT

The present invention describes a method of dynamical adjustment for manufacturing a thermally treated steel sheet. The method includes:

A. a control step, wherein at least one sensor detects a deviation happening during the thermal treatment, B. a calculation step performed when the deviation is detected during the thermal treatment such that a new thermal path $TP_{target}$ is determined to reach $m_{target}$ taking the deviation into account, such calculation step including:

1) a calculation substep, wherein at least two thermal path, $TP_x$ corresponding to one microstructure $m_x$ obtained at the end of $TP_x$, are calculated based on TT and the microstructure $m_i$ of the steel sheet to reach $m_{target}$, (Continued)

2) a selection substep wherein one new thermal path $TP_{target}$ to reach $m_{target}$ is selected, $TP_{target}$ being chosen from said $TP_x$ and being selected such that $m_x$ is the closest to $m_{target}$, C. a new thermal treatment step, wherein $TP_{target}$ is performed online on the steel sheet.

19 Claims, 4 Drawing Sheets

(51) Int. Cl.

| | |
|---|---|
| ***C22C 38/38*** | (2006.01) |
| ***C22C 38/22*** | (2006.01) |
| ***C22C 38/20*** | (2006.01) |
| ***C22C 38/00*** | (2006.01) |
| ***C22C 38/28*** | (2006.01) |

(52) U.S. Cl.
CPC ..... *C22C 38/002* (2013.01); *C22C 38/20* (2013.01); *C22C 38/22* (2013.01); *C22C 38/28* (2013.01); *C22C 38/38* (2013.01); *C21D 2211/001* (2013.01); *C21D 2211/002* (2013.01); *C21D 2211/003* (2013.01); *C21D 2211/005* (2013.01); *C21D 2211/008* (2013.01); *C21D 2211/009* (2013.01)

(58) Field of Classification Search
CPC ..... C21D 2211/002; C21D 2211/003; C21D 2211/005; C21D 2211/008; C21D 2211/009; C21D 9/46; C21D 9/48; C22C 38/001; C22C 38/002; C22C 38/20; C22C 38/22; C22C 38/28; C22C 38/38
See application file for complete search history.

(56) References Cited

U.S. PATENT DOCUMENTS

| | | | |
|---|---|---|---|
| 6,185,970 | B1 | 2/2001 | Latzel |
| 2003/0089431 | A1 | 5/2003 | Gramckow et al. |
| 2004/0205951 | A1 | 10/2004 | Kurz et al. |
| 2005/0016712 | A1 | 1/2005 | Franz et al. |
| 2007/0198122 | A1 | 8/2007 | Weinzierl |
| 2008/0135137 | A1 | 6/2008 | Okamoto et al. |
| 2009/0265146 | A1 | 10/2009 | Franz et al. |
| 2014/0175713 | A1 | 6/2014 | Roessiger et al. |
| 2019/0352738 | A1 | 11/2019 | Bonnet et al. |

FOREIGN PATENT DOCUMENTS

| | | | |
|---|---|---|---|
| CN | 106011435 | A | 10/2016 |
| EP | 1970457 | A1 | 9/2008 |
| EP | 2287345 | A1 | 2/2011 |
| JP | H01298114 | A | 12/1989 |
| JP | 2006-193759 | A | 7/2006 |
| JP | 2007231409 | A | 9/2007 |
| JP | 2020509241 | A | 3/2020 |
| RU | 2363740 | C2 | 8/2009 |
| WO | 2017050311 | A1 | 3/2017 |
| WO | WO2017050311 | A1 | 3/2017 |

OTHER PUBLICATIONS

International Preliminary Report on Patentability issued in connection with International application No. PCT/IB2017/058189 dated Apr. 16, 2019.

METHOD OF DYNAMICAL ADJUSTMENT FOR MANUFACTURING A THERMALLY TREATED STEEL SHEET

FIELD OF THE INVENTION

The present invention relates to a method of dynamical adjustment for manufacturing a thermally treated steel sheet having a chemical steel composition and a microstructure $m_{target}$ comprising from 0 to 100% of at least one phase chosen among: ferrite, martensite, bainite, pearlite, cementite and austenite, in a heat treatment line.

BACKGROUND

It is known to use coated or bare steel sheets for the manufacture of automotive vehicles. A multitude of steel grades are used to manufacture a vehicle. The choice of steel grade depends on the final application of the steel part. For example, IF (Interstitial-Free) steels can be produced for an exposed part, TRIP (Transformation-Induced Plasticity) steels can be produced for seat and floor cross members or A-pillars, and DP (Dual Phase) steels can be produced for rear rails or roof cross member.

During the production of these steels, crucial treatments are performed on the steel in order to obtain the desired part having excepted mechanical properties for one specific application. Such treatments can be, for example, a continuous annealing before deposition of a metallic coating or a quenching and partitioning treatment. These treatments are performed in an adapted furnace line.

During these treatments, some unplanned deviations can appear online. For example, a temperature in the furnace, the thickness of the steel sheet, the line speed can vary.

U.S. Pat. No. 4,440,583 relates to a method of controlled cooling for steel strip implemented by use of a cooling apparatus comprising a plurality of nozzles disposed in the direction in which strip travels, the nozzles spraying coolant against the hot running strip, and a flow-rate control valve attached to the pipe that supplies the coolant to the nozzles. By using an equation containing the thickness of strip, the cooling starting and finishing temperatures, and the desired cooling rate, the heat transfer rate needed to obtain the desired cooling rate is calculated, and the obtained heat transfer rate is corrected according to the effect of natural cooling in idle-pass zones preceding and following the coolant spray zone. Then, the flow rate of the coolant is derived, and set, from its pre-established relationship with the heat transfer rate. The length of the coolant spraying zone along the strip travel path is calculated using the running speed of the strip, the cooling starting and finishing temperatures, and the desired cooling rate. The nozzles are set to turn on and off so that coolant is sprayed from only such a number of nozzles as correspond to the calculated value. When strip thickness varies while controlled cooling is being effected, the heat transfer rate is re-calculated, on the basis of the above settings, to correct the coolant flow rate accordingly. When strip speed varies, the length of the coolant spraying region is re-calculated to correct the on-off pattern of the nozzles.

In this method, when a deviation appears, the heat transfer rate or the length of the coolant spraying region is re-calculated to correct the deviation. This method does not take into account the steel sheet characteristics comprising chemical composition, microstructure, properties, surface texture, etc. Thus, there is a risk that the same correction is applied to any kind of steel sheet even if each steel sheet has its own characteristics. The method allows for a non-personalized cooling treatment of a multitude of steel grades.

Consequently, the correction is not adapted to one specific steel and therefore at the end of the treatment, the desired properties are not obtained. Moreover, after the treatment, the steel can have a big dispersion of the mechanical properties. Finally, even if a wide range of steel grades can be manufactured, the quality of the treated steel is poor.

SUMMARY OF THE INVENTION

An object of various embodiments of the present invention is to solve the above drawbacks by providing a method of dynamical adjustment for manufacturing a thermally treated steel sheet having a specific chemical steel composition and a specific microstructure $m_{target}$ to reach in a heat treatment line.

Another object of the present invention is to adjust a thermal path online by providing a treatment adapted to each steel sheet, such treatment being calculated very precisely in the lowest calculation time possible.

Another object of the present invention is to provide a steel sheet having the expected properties, such properties having the minimum of properties dispersion possible.

The present invention provides a method of dynamical adjustment for manufacturing a thermally treated steel sheet having a chemical steel composition and a microstructure $m_{target}$ comprising from 0 to 100% of at least one phase chosen among: ferrite, martensite, bainite, pearlite, cementite and austenite, in a heat treatment line, wherein a predefined thermal treatment TT is performed on the steel sheet, such method comprising:

A. a control step wherein at least one sensor detects a deviation happening during the thermal treatment, B. a calculation step performed when the deviation is detected during the thermal treatment such that a new thermal path $TP_{target}$ is determined to reach $m_{target}$ taking the deviation into account, such calculation step comprising:

1) a calculation substep, wherein at least two thermal path, $TP_x$ corresponding to one microstructure $m_x$ obtained at the end of $TP_x$, are calculated based on TT and the microstructure $m_i$ of the steel sheet to reach $m_{target}$, 2) a selection substep wherein one new thermal path $TP_{target}$ to reach $m_{target}$ is selected, $TP_{target}$ being chosen from said $TP_x$ and being selected such that $m_x$ is the closest to $m_{target}$, C. a new thermal treatment step, wherein $TP_{target}$ is performed online on the steel sheet.

In some embodiments, in step A, the deviation is due to a variation of one process parameter chosen from among: a furnace temperature, a steel sheet temperature, an amount of gas, a gas composition, a gas temperature, a line speed, a failure in the heat treatment line, a variation of the hot-dip bath, a steel sheet emissivity and a variation of the steel thickness.

In some embodiments, the phases are defined by at least one element chosen from: a size, a shape and a chemical composition.

In some embodiments, the microstructure $m_{target}$ comprises:

100% of austenite, from 5 to 95% of martensite, from 4 to 65% of bainite, the balance being ferrite, from 8 to 30% of residual austenite, from 0.6 to 1.5% of carbon in solid solution, the balance being ferrite, martensite, bainite, pearlite and/or cementite, from 1% to 30% of ferrite and from 1% to 30% of bainite, from 5 and 25% of austenite, the balance being martensite, from 5 to 20% of residual austenite, the balance being martensite, ferrite and residual austenite, residual austenite and intermetallic phases, from 80 to 100% of martensite and from 0 to 20% of residual austenite, 100% martensite, from 5 to 100% of pearlite and from 0 to 95% of ferrite, and at least 75% of equiaxed ferrite, from 5 to 20% of martensite and bainite in amount less than or equal to 10%.

In some embodiments, the steel sheet is a Dual Phase steel, a Transformation Induced Plasticity steel, a Quenched & Partitioned steel, a Twins Induced Plasticity steel, a Carbide Free Bainite steel, a Press Hardening Steel, or a TRIPLEX, DUPLEX and Dual Phase High Ductility steel.

In some embodiments, the differences between phases proportions of phase present in $m_{target}$ and $m_x$ is ±3%.

In some embodiments, in step B.1), the thermal enthalpy H released or consumed between $m_i$ and $m_{target}$ is calculated such that:

$H_X=(X_{ferrite}*H_{ferrite})+(X_{martensite}*H_{martensite})+(X_{bainite}*H_{bainite})+(X_{pearlite}*H_{pearlite})+(H_{cementite}*X_{cementite})+(H_{austenite}*X_{austenite})$, X being a phase fraction.

In some embodiments, in step B.1), the all thermal cycle $TP_x$ is calculated such that:

$$T(t+\Delta t) = T(t) + \frac{(\varphi_{Convection} + \varphi_{radiance})}{\rho \cdot Ep \cdot C_{pe}}\Delta t \pm \frac{Hx}{C_{pe}},$$

wherein Cpe: the specific heat of the phase ($J \cdot kg^{-1} \cdot K^{-1}$), ρ: the density of the steel ($g \cdot m^{-3}$), Ep: thickness of the steel (m), φ: the heat flux (convective+radiative in W), $H_x$ ($J \cdot kg^{-1}$), T: temperature (° C.) and t: time (s).

In some embodiments, in step B.1), at least one intermediate steel microstructure $m_{xint}$ corresponding to an intermediate thermal path $TP_{xint}$ and the thermal enthalpy $H_{xint}$ are calculated.

In some embodiments, in step in step B.1), $TP_x$ is the sum of all $TP_{xint}$ and $H_x$ is the sum of all $H_{xint}$.

In some embodiments, before step B.1), at least one targeted mechanical property $P_{target}$ chosen among yield strength YS, Ultimate Tensile Strength UTS, elongation hole expansion, formability is selected.

In some embodiments, $m_{target}$ is calculated based on $P_{target}$.

In some embodiments, in step B.1), process parameters undergone by the steel sheet before entering the heat treatment line are taken into account to calculate $TP_x$.

In some embodiments, the process parameters comprise at least one element chosen from among: a cold rolling reduction rate, a coiling temperature, a run out table cooling path, a cooling temperature and a coil cooling rate.

In some embodiments, in step B.1), process parameters of the treatment line that the steel sheet will undergo in the heat treatment line are taken into account to calculate $TP_x$.

In some embodiments, the process parameters comprise at least one element chosen from among: a specific thermal steel sheet temperature to reach, a line speed, a cooling power of the cooling sections, a heating power of the heating sections, an overaging temperature, a cooling temperature, a heating temperature and a soaking temperature.

In some embodiments, the thermal path, $TP_x$, $TP_{xint}$, TT or $TP_{target}$ comprise at least one treatment chosen from: a heating, an isotherm or a cooling treatment.

In some embodiments, every time a new steel sheet enters into the heat treatment line, a new calculation step B.1) is automatically performed.

In some embodiments, an adaptation of the thermal path is performed as the steel sheet enters into the heat treatment line on the first meters of the sheet.

In some embodiments, an automatic calculation is performed during the thermal treatment to check if any deviation had appeared.

The present invention also provides a coil made of a steel sheet comprising a predefined product types comprising DP, TRIP, Q&P, TWIP, CFB, PHS, TRIPLEX, DUPLEX, DP, or HD, the steel obtained by a method described above, the coil having a standard variation of mechanical properties below or equal to 25 MPa between any two points along the coil. In some embodiments, a standard variation is below or equal to 15 MPa between any two points along the coil. In some embodiments, a standard variation is below or equal to 9 MPa between any two points along the coil.

The present invention further provides a thermal treatment line adapted for an implementation of the methods described above.

The present invention further provides a computer program product comprising at least a metallurgical module, an optimization module and a thermal module cooperating together to determine $TP_{target}$, such modules comprising software instructions that when implemented by a computer implement a method according to the embodiments described above.

Other characteristics and advantages of the invention will become apparent from the following detailed description of the invention.

BRIEF DESCRIPTION OF THE DRAWINGS

To illustrate the invention, various embodiments of non-limiting examples will be described, particularly with reference to the following Figures.

DETAILED DESCRIPTION

Figure 1:
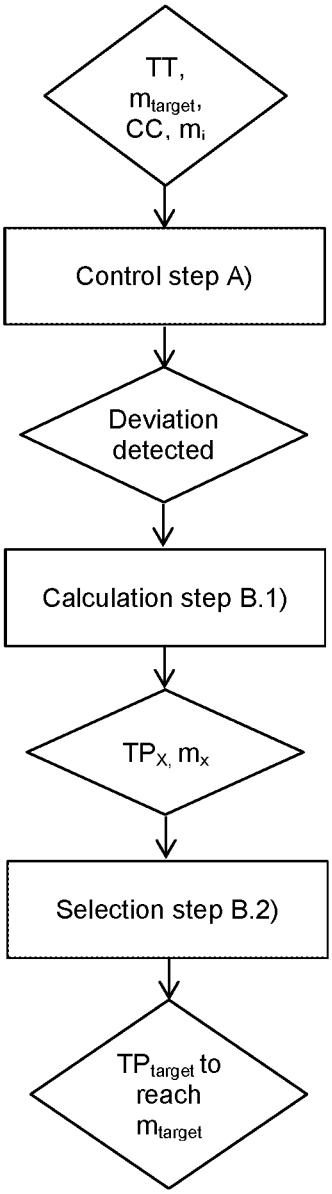
FIG. 1 illustrates an example of an embodiment of the present invention.

The following terms will be defined:

CC: chemical composition in percentage in weight percent, $m_{target}$: targeted value of the microstructure, $m_{standard}$: the microstructure of the selected product, $P_{target}$: targeted value of a mechanical property, $m_i$: initial microstructure of the steel sheet, X: phase fraction in weight percent, T: temperature in degree Celsius (° C.), t: time (s), s: seconds, UTS: ultimate tensile strength (MPa), YS: yield stress (MPa), metallic coating based on zinc means a metallic coating comprising above 50% of zinc, metallic coating based on aluminum means a metallic coating comprising above 50% of aluminum, TT: thermal treatment, and thermal path, TT, $TP_{target}$, $TP_x$ and $TP_{xint}$ comprises a time, a temperature of the thermal treatment and at least one rate chosen from: a cooling, an isotherm or a heating rate. The isotherm rate means a rate having a constant temperature and nanofluids: fluid comprising nanoparticles.

The designation "steel" or "steel sheet" means a steel sheet, a coil, a plate having a composition allowing the part to achieve a tensile strength up to 2500 MPa and more preferably up to 2000 MPa. For example, the tensile strength is above or equal to 500 MPa, preferably above or equal to 1000 MPa, advantageously above or equal to 1500 MPa. A wide range of chemical composition is included since the method according to the invention can be applied to any kind of steel.

The invention provides a method of dynamical adjustment for manufacturing a thermally treated steel sheet having a chemical steel composition and a microstructure $m_{target}$ comprising from 0 to 100% of at least one phase chosen among: ferrite, martensite, bainite, pearlite, cementite and austenite, in a heat treatment line wherein a predefined thermal treatment TT is performed on the steel sheet, such method comprising:

A. a control step wherein at least one sensor detects any deviation happening during the thermal treatment TT, B. a calculation step performed when a deviation is detected during the thermal treatment such that a new thermal path $TP_{target}$ is determined to reach $m_{target}$ taking the deviation into account, such calculation step comprising:

1) a calculation substep, wherein at least two thermal path, $TP_x$ corresponding to one microstructure $m_x$ at the end of $TP_x$, are calculated based on TT and the microstructure $m_i$ of the steel sheet to reach $m_{target}$, 2) a selection substep, wherein one new thermal path $TP_{target}$ to reach $m_{target}$ is selected, $TP_{target}$ being chosen from $TP_X$ and being selected such that $m_X$ is the closest to $m_{target}$, C. a new thermal treatment step wherein $TP_{target}$ is performed online on the steel sheet.

Without willing to be bound by any theory, it seems that when the method according to the present invention is applied, it is possible to correct any deviation happening during a thermal treatment by providing a personalized heat treatment depending on each steel sheet. To do so, a precise and specific new thermal path $TP_{target}$ is calculated in a short calculation time taking into account $m_{target}$, in particular the proportion of all the phases along the treatment, $m_i$ (including the microstructure dispersion along the steel sheet) and the deviation. Indeed, the method according to the present invention takes into account for the calculation the thermodynamically stable phases, i.e. ferrite, austenite, cementite and pearlite, and the thermodynamic metastable phases, i.e. bainite and martensite. Thus, a steel sheet having the expected properties with the minimum of properties dispersion possible is obtained.

In some embodiments, the microstructures $m_x$, $m_{target}$ and $m_i$ phases are defined by at least one element chosen from: the size, the shape and the chemical composition.

In some embodiments, the microstructure $m_{target}$ to reach comprises:

100% of austenite, from 5 to 95% of martensite, from 4 to 65% of bainite, the balance being ferrite, from 8 to 30% of residual austenite, from 0.6 to 1.5% of carbon in solid solution, the balance being ferrite, martensite, bainite, pearlite and/or cementite, from 1% to 30% of ferrite and from 1% to 30% of bainite, from 5 and 25% of austenite, the balance being martensite, from 5 to 20% of residual austenite, the balance being martensite, ferrite and residual austenite, residual austenite and intermetallic phases, from 80 to 100% of martensite and from 0 to 20% of residual austenite, 100% martensite, from 5 to 100% of pearlite and from 0 to 95% of ferrite, and at least 75% of equiaxed ferrite, from 5 to 20% of martensite and bainite in amount less than or equal to 10%.

In some embodiments, the steel sheets can be any kind of steel grade, including, e.g., Dual Phase DP, Transformation Induced Plasticity (TRIP), Quenched & Partitioned steel (Q&P), Twins Induced Plasticity (TWIP), Carbide Free Bainite (CFB), Press Hardening Steel (PHS), TRIPLEX, DUPLEX and Dual Phase High Ductility (DP HD) steels.

The chemical composition depends on each steel sheet. For example, the chemical composition of a DP steel can comprise:

$0.05<C<0.3\%$, $0.5\leq Mn<3.0\%$, $S\leq 0.008\%$, $P\leq 0.080\%$, $N\leq 0.1\%$, $Si\leq 1.0\%$, the remainder of the composition making up of iron and inevitable impurities resulting from the development.

FIG. 1 illustrates an example of an embodiment according to the present invention, wherein a TT is performed on a steel sheet in a heat treatment line, such steel sheet having a chemical composition CC and $m_{target}$ to reach.

According to an embodiment of the present invention, in step A), any deviation happening during the thermal treatment is detected. In some embodiments, the deviation is due to a variation of a process parameter chosen from among: a furnace temperature, a steel sheet temperature, an amount of gas, a gas composition, a gas temperature, a line speed, a failure in the heat treatment line, a variation of the hot-dip bath, a steel sheet emissivity and a variation of the steel thickness.

A furnace temperature can be a heating temperature, a soaking temperature, a cooling temperature, an overaging temperature, in particular in a continuous annealing.

A steel sheet temperature can be measured at any time of the heat treatment in different positions of the heat treatment line, for example:

in a heating section preferably being a direct flame furnace (DFF), a radian tube furnace (RTF), an electrical resistance furnace or an induction furnace, in cooling section, in particular, in jets cooling, in a quenching system or in a snout and in isothermal section preferably being an electrical resistance furnace.

To detect a temperature variation, the sensor can be a pyrometer or a scanner.

Usually, heat treatments can be performed in an oxidizing atmosphere, i.e. an atmosphere comprising an oxidizing gas being for example: $O_2$, $CH_4$, $CO_2$ or CO. They also can be performed in a neutral atmosphere, i.e. an atmosphere comprising a neutral gas being for example: $N_2$, Ar or He. Finally, they also can be performed in a reducing atmosphere, i.e. an atmosphere comprising a reducing gas being for example: $H_2$ or $HN_x$.

The variation of gas amount can be detected by barometer.

The line speed can be detected by a laser sensor.

For example, a failure in the heat treatment line can be:

in a direct flame furnace: a burner not working anymore, in a radiant tube furnace: a radiant tube not working anymore, in an electrical furnace: a resistance not working anymore or in a cooling section: one or several jets cooling not working anymore.

In such cases, sensor can be a pyrometer, a barometer, an electrical consumption or a camera.

The variation of the steel thickness can be detected by a laser or an ultrasound sensor.

When a deviation is detected, at least two thermal path $TP_x$, corresponding to $m_x$, are calculated based on TT and $m_i$ to reach $m_{target}$, such $TP_x$ taking into account the deviation. The calculation of $TP_x$ is based on the thermal behavior and metallurgical behavior of the steel sheet compared to the conventional methods wherein only the thermal behavior is considered.

Figure 2:
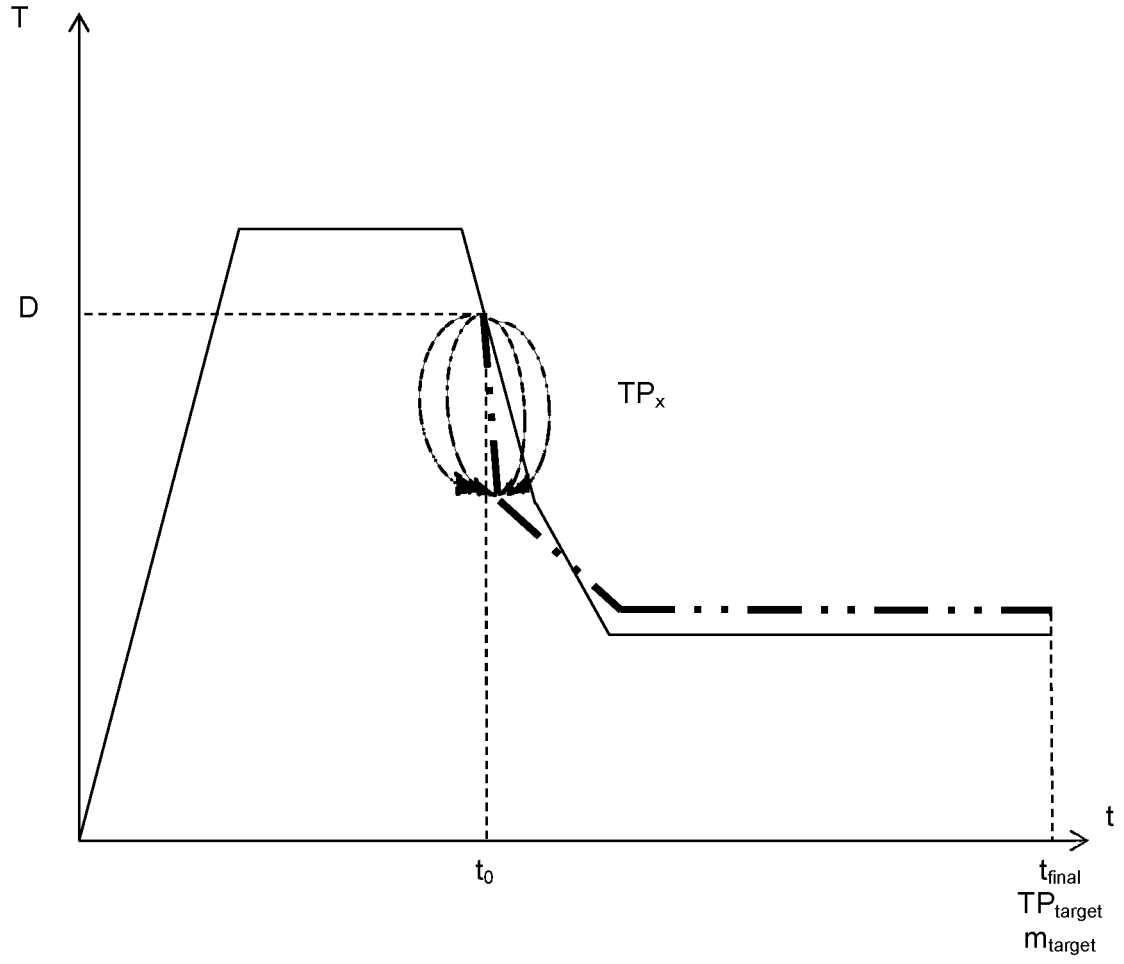
FIG. 2 illustrates a continuous annealing of a steel sheet comprising a heating step, a soaking step, a cooling step and an overaging step.

FIG. 2 illustrates a continuous annealing of a steel sheet comprising a heating step, a soaking step, a cooling step and an overaging step. A deviation D due to a variation of $T_{soaking}$ is detected. Thus, a multitude of $TP_x$ is calculated to reach $m_{target}$ as shown only for the first cooling step in FIG. 2. In this example, the calculated $TP_x$ also includes the second cooling step and the overaging step.

In some embodiments, at least 10 $TP_x$ are calculated, more preferably at least 50, advantageously at least 100 and more preferably at least 1000. For example, the number of calculated $TP_x$ is between 2 and 10000, preferably between 100 and 10000 and preferably between 1000 and 10000.

In step B.2), one new thermal path $TP_{target}$ to reach $m_{target}$ is selected. $TP_{target}$ is chosen from $TP_x$ and being selected such that $m_x$ is the closest to $m_{target}$. Thus, in FIG. 1, $TP_{target}$ is chosen from a multitude of $TP_x$. Preferably, the differences between phases proportions of each phase present in $m_{target}$ and $m_x$ is +3%.

In some embodiments, in step B.1), the thermal enthalpy H released or consumed between $m_i$ and $m_{target}$ is calculated such that:

$$H_x=(X_{ferrite}*H_{ferrite})+(X_{martensite}*H_{martensite})+(X_{bainite}*H_{bainite})+(X_{pearlite}*H_{pearlite})+(H_{cementite}*X_{cementite})+(H_{austenite}*X_{austenite})$$

X being a phase fraction.

Without willing to be bound by any theory, H represents the energy released or consumed along the all thermal path when a phase transformation is performed. It is believed that some phase transformations are exothermic and some of them are endothermic. For example, the transformation of ferrite into austenite during a heating path is endothermic whereas the transformation of austenite into pearlite during a cooling path is exothermic. Preferably, $H_x$ is taken in account in the calculation of $TP_x$.

In one embodiment, in step B.1), the all thermal cycle $TP_x$ is calculated such that:

$$T(t+\Delta t)=T(t)+\frac{(\varphi_{Convection}+\varphi_{radiance})}{\rho\cdot Ep\cdot C_{pe}}\Delta t\pm\frac{Hx}{C_{pe}}$$

with Cpe: the specific heat of the phase ($J\cdot kg^{-1}\cdot K^{-1}$), ρ: the density of the steel ($g\cdot m^{-3}$), Ep: the thickness of the steel (m), φ: the heat flux (convective and radiative in W), $H_x$($J\cdot kg^{-1}$), T: temperature (° C.) and t: time (s).

In some embodiments, in step B.1), at least one intermediate steel microstructure $m_{xint}$ corresponding to an intermediate thermal path $TP_{xint}$ and the thermal enthalpy $H_{xint}$ are calculated. In this case, the calculation of $TP_x$ is obtained by the calculation of a multitude of $TP_{xint}$. Thus preferably, $TP_x$ is the sum of all $TP_{xint}$ and $H_x$ is the sum of all $H_{xint}$. In this preferred embodiment, $TP_{xint}$ is calculated periodically. For example, it is calculated every 0.5 seconds, preferably 0.1 seconds or less.

Figure 3:
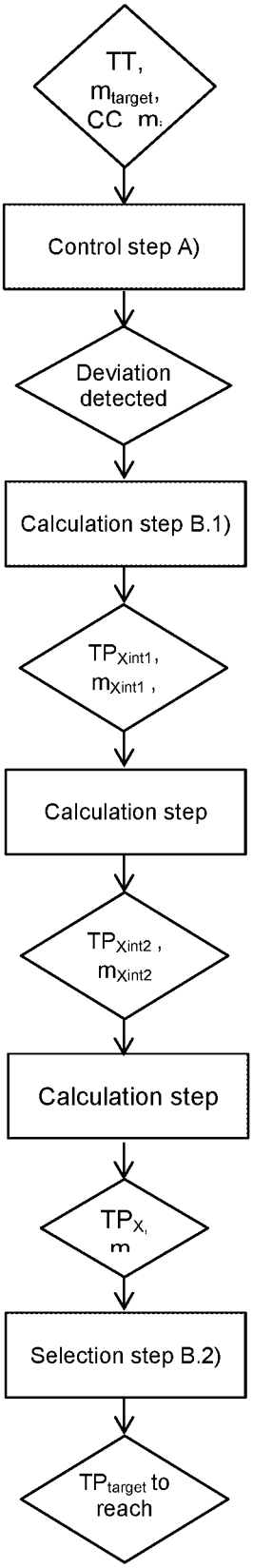
FIG. 3 illustrates an example of an embodiment of the present invention.

FIG. 3 illustrates an embodiment of the present invention, wherein in step B. 1), $m_{int1}$ and $m_{int2}$ corresponding respectively to $TP_{xint1}$ and $TP_{xint2}$ as well as $H_{xint1}$ and $H_{xint2}$ are calculated. $H_x$ during the all thermal path is determined to calculate $TP_x$. according to the present invention, a multitude, i.e more than 2, of $TP_{xint}$, $m_{xint}$ and $H_{xint}$ are calculated to obtain $TP_x$.

In some embodiments, before step B.2), at least one targeted mechanical property $P_{target}$ chosen among yield strength YS, Ultimate Tensile Strength UTS, elongation hole expansion, formability is selected. In these embodiments, preferably, $m_{target}$ is calculated based on $P_{target}$.

Without willing to be bound by any theory, it is believed that the characteristics of the steel sheet are defined by the process parameters applied during the steel production. Thus, In some embodiments, in step B.1), the process parameters undergone by the steel sheet before entering the heat treatment line are taken into account to calculate $TP_x$. For example, the process parameters comprise at least one element chosen from among: a cold rolling reduction rate, a coiling temperature, a run out table cooling path, a cooling temperature and a coil cooling rate.

In some embodiments, the process parameters of the treatment line that the steel sheet will undergo in the heat treatment line are taken into account to calculate $TP_x$. For example, the process parameters comprise at least one element chosen from among: a specific thermal steel sheet temperature to reach, the line speed, cooling power of the cooling sections, heating power of the heating sections, an overaging temperature, a cooling temperature, a heating temperature and a soaking temperature.

In some embodiments, the thermal path, $TP_x$, $TP_{xint}$, TT or $TP_{target}$ comprise at least one treatment chosen from: a heating, an isotherm or a cooling treatment. For example, the thermal path can be a recrystallization annealing, a press hardening path, a recovery path, an intercritical or full austenitic annealing, a tempering path, a partitioning path, isothermal path or a quenching path.

In some embodiments, a recrystallization annealing is performed. The recrystallization annealing comprises optionally a pre-heating step, a heating step, a soaking step, a cooling step and optionally an equalizing step. In one embodiment, it is performed in a continuous annealing furnace comprising optionally a pre-heating section, a heating section, a soaking section, a cooling section and optionally an equalizing section. Without willing to be bound by any theory, it is believed that the recrystallization annealing is the thermal path the more difficult to handle since it comprises many steps to take into account comprising cooling and heating steps.

In some embodiments, every time a new steel sheet enters into the heat treatment line, a new calculation step B.1) is automatically performed. Indeed, the method according to the present invention adapts the thermal path $TP_{target}$ to each steel sheet even if the same steel grade enters in the heat treatment line since the real characteristics of each steel often differs. The new steel sheet can be detected and the new characteristics of the steel sheet are measured and are pre-selected beforehand. For example, a sensor detects the welding between two coils.

In some embodiments, the adaptation of the thermal path is performed as the steel sheet entries into the heat treatment line on the first meters of the sheet in order to avoid strong process variation.

In some embodiments, an automatic calculation is performed during the thermal treatment to check if any deviation had appeared. In these embodiments, periodically, a calculation is realized to verify if a slight deviation had occurred. Indeed, the detection threshold of sensor is sometimes too high which means that a slight deviation is not always detected. The automatic calculation, performed for example every few seconds, is not based on a detection threshold. Thus, if the calculation leads to the same thermal treatment, i.e. the thermal treatment performs online, TT will not change. If the calculation leads to a different treatment due to a slight deviation, the treatment will change.

Figure 4:
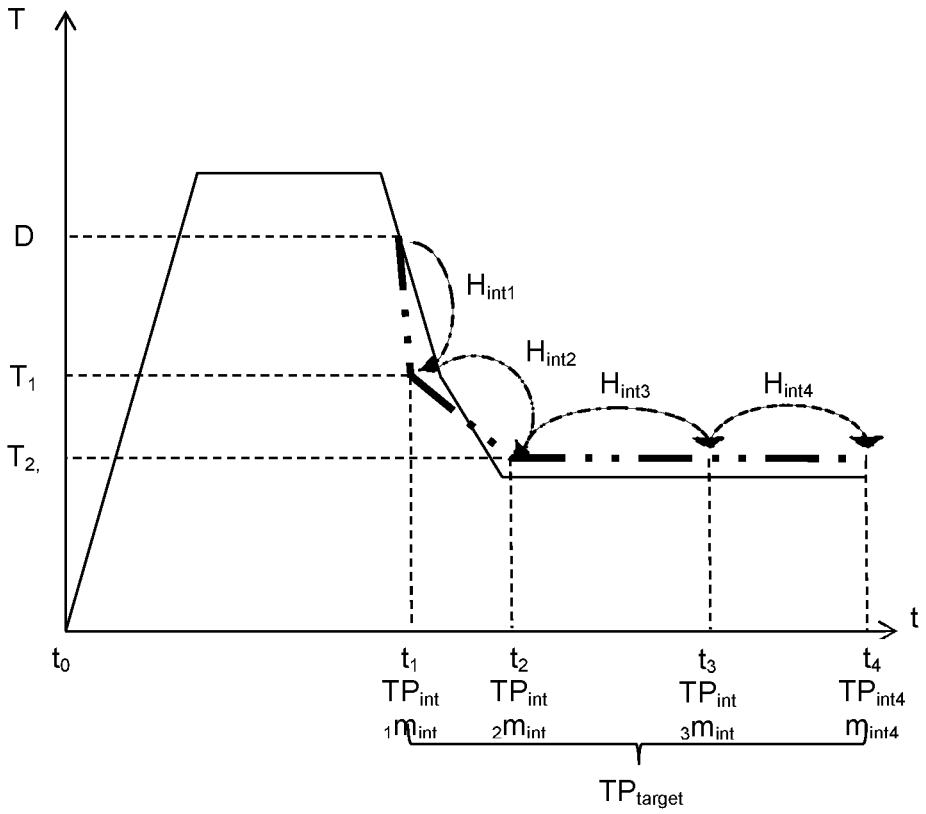
FIG. 4 illustrates an example of an embodiment according to the present invention, wherein a continuous annealing is performed on a steel sheet before the deposition of a coating by hot-dip.

FIG. 4 illustrates one example according to the present invention, wherein a continuous annealing is performed on a steel sheet before the deposition of a coating by hot-dip. With the method according to one embodiment of the present invention, when a deviation D appears, $TP_x$ is calculated based on $m_t$, the selected product, TT and $m_{target}$. In this example, intermediate thermal paths $TP_{xint1}$ to $TP_{xint4}$, corresponding respectively $m_{xint1}$ to $m_{xint4}$, and $H_{xint1}$ to $H_{xint4}$ are calculated. $H_x$ is determined in order to obtain $TP_x$. In this Figure, the represented $TP_{target}$ has been chosen from $TP_x$.

With the method according to an embodiment of the present invention, when a deviation appears, a new thermal treatment step comprising $TP_{target}$ is performed on the steel sheet in order to reach $m_{target}$.

The present invention also provides a coil made of a steel sheet including said predefined product types, including, e.g., DP, TRIP, Q&P, TWIP, CFB, PHS, TRIPLEX, DUPLEX, DP or HD steels, such coil having a standard variation of mechanical properties below or equal to 25 MPa, preferably below or equal to 15 MPa, more preferably below or equal to 9 MPa, between any two points along the coil. Indeed, without willing to be bound by any theory, it is believed that the method including the calculation step B.1) takes into account the microstructure dispersion of the steel sheet along the coil. Thus, $TP_{target}$ applied on the steel sheet allows for a homogenization of the microstructure and also of the mechanical properties.

The low value of standard variation is due to the precision of $TP_{target}$. In some embodiments, the mechanical properties are chosen from YS, UTS or elongation.

In some embodiments, the coil is covered by a metallic coating based on zinc or based on aluminum.

In some embodiments, in an industrial production, the standard variation of mechanical properties between 2 coils made of a steel sheet including said predefined product types, including, e.g., DP, TRIP, Q&P, TWIP, CFB, PHS, TRIPLEX, DUPLEX, DP HD steels, measured and successively produced on the same line is below or equal to 25 MPa, preferably below or equal to 15 MPa, more preferably below or equal to 9 MPa.

A thermal treatment line for the implementation of a method according to the present invention is used to perform $TP_{target}$. For example, the thermally treatment line is a continuous annealing furnace, a press hardening furnace, a batch annealing or a quenching line.

Finally, the present invention provides a computer program product comprising at least a metallurgical module, a thermal module and an optimization module that cooperate together to determine $TP_{target}$ such modules comprising software instructions that when implemented by a computer implement the method according to the present invention.

The metallurgical module predicts the microstructure ($m_y$, $m_{target}$ including metastable phases: bainite and martensite and stables phases: ferrite, austenite, cementite and pearlite) and more precisely the proportion of phases all along the treatment and predicts the kinetic of phases transformation.

The thermal module predicts the steel sheet temperature depending on the installation used for the thermal treatment, the installation being for example a continuous annealing furnace, the geometric characteristics of the band, the process parameters including the power of cooling, heating or isotherm power, the dynamic thermal enthalpy H released or consumed along the all thermal path when a phase transformation is performed.

The optimization module determines the best thermal path to reach $m_{target}$, i.e. $TP_{target}$ following the method according to the present invention using the metallurgical and thermal modules.

EXAMPLES

In the following examples, DP780GI having the following chemical composition was chosen:

| C (%) | Mn (%) | Si (%) | Cr (%) | Mo (%) | P (%) | Cu (%) | Ti (%) | N (%) |
|---|---|---|---|---|---|---|---|---|
| 0.145 | 1.8 | 0.2 | 0.2 | 0.0025 | 0.015 | 0.02 | 0.025 | 0.06 |

The cold-rolling had a reduction rate of 55% to obtain a thickness of 1.2 mm.

$m_{target}$ to reach comprised 12% of martensite, 58% of ferrite and 30% of bainite, corresponding to the following $P_{target}$:YS of 460 MPa and UTS of 790 MPa. A cooling temperature $T_{cooling}$ of 460° C. has also to be reached in order to perform a hot-dip coating with a zinc bath. This temperature must be reached with an accuracy of +/−2° C. to guarantee good coatability in the Zn bath.

The thermal treatment TT to perform on the steel sheet is as follows:

- a pre-heating step wherein the steel sheet is heated from ambient temperature to 680° C. during 37.5 seconds,
- a heating step wherein the steel sheet is heated from 680° C. to 780° C. during 40 seconds,
- soaking step wherein the steel sheet is heated at a soaking temperature $T_{soaking}$ of 780° C. during 24.4 seconds,
- a cooling step wherein the steel sheet is cooled with 11 jets cooling spraying $HN_x$ as follows:

| Jets | Jet 1 | Jet 2 | Jet 3 | Jet 4 | Jet 5 | Jet 6 | Jet 7 | Jet 8 | Jet 9 | Jet 10 | Jet 11 |
|---|---|---|---|---|---|---|---|---|---|---|---|
| Cooling rate (° C./s) | 10 | 10 | 9 | 5 | 9 | 22 | 50 | 18 | 18 | 21 | 11 |
| Time (s) | 1.89 | 1.89 | 1.89 | 1.89 | 1.68 | 1.8 | 1.8 | 1.63 | 1.63 | 1.63 | 1.63 |
| T (° C.) | 754 | 734 | 718 | 708 | 693 | 653 | 563 | 533 | 504 | 481 | 463 |
| Cooling power (%) | 0 | 0 | 0 | 0 | 0 | 0 | 28 | 100 | 100 | 100 | 100 |

a hot-dip coating in a zinc bath a 460° C.,
the cooling of the steel sheet until the top roll during 27.8 s at 300° C. and
the cooling of the steel sheet at ambient temperature.

Example 1: Deviation of $T_{soaking}$

When the soaking temperature $T_{soaking}$ decreased from 780° C. to 765° C., a new thermal path $TP_{target1}$ is determined to reach $m_{target}$ taking the deviation into account. To this end, a multitude of thermal path $TP_x$ was calculated based on TT, $m_i$ of DP780GI to reach $m_{target}$ and the deviation.

After the calculation of $TP_x$, one new thermal path $TP_{target1}$ to reach $m_{target}$ was selected, $TP_{target1}$ being chosen from $TP_x$ and being selected such that $m_x$ is the closest to $m_{target}$. $TP_{target1}$ is as follows:

a soaking step wherein the steel sheet is heated at a soaking temperature $T_{soaking}$ of 765° C. during 24.4 seconds due to a deviation in the soaking section of the heat treatment line, a cooling step wherein the steel sheet is cooled with 11 jets cooling spraying $HN_x$ as follows:

| Jets | Jet 1 | Jet 2 | Jet 3 | Jet 4 | Jet 5 | Jet 6 | Jet 7 | Jet 8 | Jet 9 | Jet 10 | Jet 11 |
|---|---|---|---|---|---|---|---|---|---|---|---|
| Cooling rate (° C./s) | 9 | 9 | 10 | 15 | 32 | 28 | 31 | 11 | 10 | 7 | 8 |
| Time (s) | 1.89 | 1.89 | 1.89 | 1.89 | 1.68 | 1.8 | 1.8 | 1.63 | 1.63 | 1.63 | 1.63 |
| T (° C.) | 742 | 725 | 706 | 679 | 625 | 574 | 518 | 500 | 483 | 472 | 459 |
| Cooling power (%) | 0 | 0 | 0 | 25 | 50 | 50 | 45 | 45 | 45 | 45 | 45 |

a hot-dip coating in a zinc bath a 460° C.,
the cooling of the steel sheet until the top roll during 27.8 s at 300° C. and
the cooling of the steel sheet at ambient temperature.

Example 2: Steel Sheet Having a Different Composition

A new steel sheet DP780GI entered into the heat treatment line so a calculation step was automatically performed based on the following new CC:

| C (%) | Mn (%) | Si (%) | Cr (%) | Mo (%) | P (%) | Cu (%) | Ti (%) | N (%) |
|---|---|---|---|---|---|---|---|---|
| 0.153 | 1.830 | 0.225 | 0.190 | 0.0025 | 0.015 | 0.020 | 0.025 | 0.006 |

The new thermal path $TP_{target2}$ was determined to reach $m_{target}$ taking the new CC into account. $TP_{target2}$ is as follows:

a pre-heating step wherein the steel sheet is heated from ambient temperature to 680° C. during 37.5 seconds, a heating step wherein the steel sheet is heated from 680° C. to 780° C. during 40 seconds, a soaking step wherein the steel sheet is heated at a soaking temperature $T_{soaking}$ of 780° C. during 24.4 seconds, a cooling step wherein the steel sheet is cooled with 11 jets cooling spraying $HN_x$

| Jets | Jet 1 | Jet 2 | Jet 3 | Jet 4 | Jet 5 | Jet 6 | Jet 7 | Jet 8 | Jet 9 | Jet 10 | Jet 11 |
|---|---|---|---|---|---|---|---|---|---|---|---|
| Cooling rate (° C./s) | 17 | 17 | 9 | 6 | 6 | 6 | 38 | 30 | 18 | 17 | 10 |
| Time (s) | 2.2 | 2.2 | 2.2 | 2.2 | 1.96 | 2.1 | 2.1 | 1.9 | 1.9 | 1.9 | 1.9 |
| T (° C.) | 737 | 705 | 688 | 677 | 667 | 655 | 586 | 537 | 508 | 481 | 464 |

-continued

| Jets | Jet 1 | Jet 2 | Jet 3 | Jet 4 | Jet 5 | Jet 6 | Jet 7 | Jet 8 | Jet 9 | Jet 10 | Jet 11 |
|---|---|---|---|---|---|---|---|---|---|---|---|
| Cooling power (%) | 100 | 100 | 30 | 0 | 0 | 0 | 100 | 100 | 100 | 100 | 100 |

a hot-dip coating in a zinc bath a 460° C., the cooling of the steel sheet until the top roll during 26.8 s at 300° C. and the cooling of the steel sheet at ambient temperature.

Table 1 shows the steel properties obtained with TT, $TP_{target1}$ and $TP_{target2}$:

| | TT | $TP_{target1}$ | $TP_{target2}$ | Expected properties |
|---|---|---|---|---|
| $T_{cooling}$ obtained (° C.) | 461 | 458 | 462 | 460 |
| Microstructure obtained at the end of the thermal path | $X_{martensite}$: 12%<br>$X_{ferrite}$: 55%<br>$X_{bainite}$: 33% | $X_{martensite}$: 12%<br>$X_{ferrite}$: 61%<br>$X_{bainite}$: 27% | $X_{martensite}$: 14%<br>$X_{ferrite}$: 55%<br>$X_{bainite}$: 32% | $X_{martensite}$: 12%<br>$X_{ferrite}$: 58%<br>$X_{bainite}$: 30% |
| Deviation (écart) with respect to $m_{target}$ | $X_{martensite}$: 0%<br>$X_{ferrite}$: 3%<br>$X_{bainite}$: 3% | $X_{martensite}$: 0%<br>$X_{ferrite}$: 3%<br>$X_{bainite}$: 3% | $X_{martensite}$: 2%<br>$X_{ferrite}$: 3%<br>$X_{bainite}$: 2% | — |
| YS (MPa) | 453.5 | 465 | 462 | 460 |
| YS deviation with respect to $P_{target}$ (MPa) | 6.5 | 5 | 2 | — |
| UTS (MPa) | 786.8 | 790 | 804 | 790 |
| UTS deviation with respect to $P_{target}$ (MPa) | 3.2 | 0 | 14 | — |

With the method according to the various embodiments of the present invention, it is possible to adjust a thermal TT when a deviation appears or when a new steel sheet having a different CC enters into the heat treatment line. By applying the new thermal paths $TP_{target1}$ and $TP_{target2}$, it is possible to obtain a steel sheet having the desired expected properties, each $TP_{target}$ being precisely adapted to each deviation.

What is claimed is:

1. A method of dynamical adjustment for manufacturing a thermally treated steel sheet having a chemical steel composition and a microstructure $m_{target}$ comprising from 0 to 100% of at least one phase chosen among: ferrite, martensite, bainite, pearlite, cementite and austenite such that $m_{target}$=Xferrite+Xmartensite+Xbainite+Xpearlite+Xcementite+Xaustenite, X being a phase fraction, in a heat treatment line, wherein a predefined thermal treatment TT including thermal treatment steps is performed on the steel sheet sequentially in the heat treatment line, such method comprising:

performing at least one of the thermal treatment steps of the predefined thermal treatment TT on the steel sheet in the heat treatment line, A. a control step wherein at least one sensor detects a deviation happening in the heat treatment line during the performed at least one thermal treatment step, the deviation being such that the predefined thermal treatment TT is determined to produce a microstructure different from $m_{target}$, B. a calculation step performed when the deviation is detected during the thermal treatment such that a new thermal path $TP_{target}$, performed as at least one further heat treatment step in the heat treatment line sequentially downstream from the performed at least one thermal treatment step, is determined to reach $m_{target}$ taking the deviation into account, such calculation step comprising:

1) a calculation substep, wherein at least two thermal paths $TP_x$, each performed as at least one further heat treatment step in the heat treatment line sequentially downstream from the performed at least one thermal treatment step and corresponding to one microstructure $m_x$ obtained at the end of $TP_x$, are calculated based on TT, including the performed at least one thermal treatment step, and the microstructure $m_i$ of the steel sheet to reach $m_{target}$, the calculation substep taking into consideration a thermal enthalpy $H_x$ released or consumed between $m_i$ and $m_{target}$, the thermal enthalpy $H_x$ being calculated such that:

$$H_x=(X_{ferrite}*H_{ferrite})+(X_{martensite}*H_{martensite})+(X_{bainite}*H_{bainite})+(X_{pearlite}*H_{pearlite})+(H_{cementite}*X_{cementite})+(H_{austenite}*X_{austenite})$$

2) a selection substep wherein one new thermal path $TP_{target}$ to reach $m_{target}$ is selected, $TP_{target}$ being chosen from one of the at least two thermal paths $TP_x$ calculated in substep B.1) and being selected such that $m_x$ is the closest to $m_{target}$, C. performing a new thermal treatment step in the heat treatment line sequentially downstream from the performed at least one thermal treatment step by modifying at least one of a time, a temperature or rate of one of the thermal treatment steps of the predefined thermal treatment sequentially downstream from the performed at least one thermal treatment step, the performing of the new thermal treatment step including performing the selected new thermal treatment path $TP_{target}$ online on the steel sheet to produce a thermally treated steel sheet having a microstructure=Xferrite+Xmartensite+Xbainite+Xpearlite+Xcementite+Xaustenite with each phase X being within a predetermined threshold of the microstructure $m_{target}$.

2. A method according to claim 1, wherein in step A, the deviation is due to a variation of one process parameter chosen from among: a furnace temperature, a steel sheet temperature, an amount of gas, a gas composition, a gas temperature, a line speed, a failure in the heat treatment line, a variation of a hot-dip bath, a steel sheet emissivity and a variation of the steel thickness.

3. A method according to claim 1, wherein the at least one phase is defined by at least one element chosen from: a size, a shape and a chemical composition.

4. A method according to claim 1, wherein the microstructure $m_{target}$ is selected from a group consisting of:

100% of austenite, from 5 to 95% of martensite, from 4 to 65% of bainite, the balance being ferrite, from 8 to 30% of residual austenite, from 0.6 to 1.5% of carbon in solid solution, the balance being ferrite, martensite, bainite, pearlite and/or cementite, from 1% to 30% of ferrite and from 1% to 30% of bainite, from 5 to 25% of austenite, the balance being martensite, from 5 to 20% of residual austenite, the balance being martensite, ferrite and residual austenite, residual austenite and intermetallic phases, from 80 to 100% of martensite and from 0 to 20% of residual austenite, 100% martensite, from 5 to 100% of pearlite and from 0 to 95% of ferrite, or at least 75% of equiaxed ferrite, from 5 to 20% of martensite and bainite in amount less than or equal to 10%.

5. A method according to claim 1, wherein the steel sheet is selected from a group consisting of a Dual Phase steel, a Transformation Induced Plasticity steel, a Quenched & Partitioned steel, a Twins Induced Plasticity steel, a Carbide Free Bainite steel, a Press Hardening Steel, a TRIPLEX steel, or a DUPLEX steel.

6. A method according to claim 1, wherein in the calculation substep, the at least two thermal paths $TP_x$ are calculated such that:

$$T(t+\Delta t) = T(t) + \frac{(\varphi_{Convection} + \varphi_{radiance})}{\rho \cdot Ep \cdot C_{pe}}\Delta t \pm \frac{Hx}{C_{pe}},$$

wherein Cpe: the specific heat of the phase ($J \cdot kg^{-1} \cdot K^{-1}$), ρ: the density of the steel ($g \cdot m^{-3}$), Ep: thickness of the steel (m), φ: the heat flux (convective+radiative in W), $H_x$ ($J \cdot kg^{-1}$), T: temperature (° C.) and t: time (s).

7. A method according to claim 1, wherein in the calculation substep, at least one intermediate steel microstructure $m_{xint}$ corresponding to an intermediate thermal path $TP_{xint}$ and the thermal enthalpy $H_{xint}$ are calculated.

8. A method according to claim 7, wherein in step in the calculation substep, $TP_x$ is the sum of all $TP_{xint}$ and $H_X$ is the sum of all $H_{xint}$.

9. A method according to claim 1, wherein before the calculation substep, at least one targeted mechanical property $P_{target}$ chosen among yield strength YS, Ultimate Tensile Strength UTS, elongation hole expansion, and formability is selected.

10. A method according to claim 9, wherein $m_{target}$ is calculated based on $P_{target}$.

11. A method according to claim 1, wherein in the calculation substep, process parameters undergone by the steel sheet before entering the heat treatment line are taken into account to calculate $TP_x$.

12. A method according to claim 11, wherein the process parameters comprise at least one element chosen from among: a cold rolling reduction rate, a coiling temperature, a run out table cooling path, a cooling temperature and a coil cooling rate.

13. A method according to claim 1, wherein in the calculation substep, process parameters of the treatment line that the steel sheet will undergo in the heat treatment line are taken into account to calculate $TP_x$.

14. A method according to claim 13, wherein the process parameters comprise at least one element chosen from among: a specific thermal steel sheet temperature to reach, a line speed, a cooling power of cooling sections, a heating power of heating sections, an overaging temperature, a cooling temperature, a heating temperature and a soaking temperature.

15. A method according to claim 1, wherein the thermal path, $TP_x$, TT or $TP_{target}$ comprise at least one treatment chosen from: a heating, an isotherm or a cooling treatment.

16. A method according to claim 1, wherein every time a new steel sheet enters into the heat treatment line, a new iteration of the calculation substep is automatically performed.

17. A method according to claim 16, wherein an adaptation of the predefined thermal treatment TT is performed as the steel sheet enters into the heat treatment line on the first meters of the sheet.

18. A method according to claim 1, wherein an automatic calculation is performed during the thermal treatment to check if any deviation had appeared.

19. A method according to claim 1, wherein the predetermined threshold is +/−3%.

* * * * *